United States Patent [19]

Makino

[11] 4,313,409

[45] Feb. 2, 1982

[54] CENTRIFUGAL RPM GOVERNOR FOR FUEL-INJECTED INTERNAL COMBUSTION ENGINES

[75] Inventor: Niro Makino, Toyota, Japan

[73] Assignee: Nippondenso Co. Ltd., Kariya, Japan

[21] Appl. No.: 87,895

[22] Filed: Oct. 24, 1979

[30] Foreign Application Priority Data

Oct. 24, 1978 [JP] Japan ..... 53-146546[U]

[51] Int. Cl.[3] ..... F02D 31/00

[52] U.S. Cl. ..... 123/373; 123/367; 123/198 DB

[58] Field of Search ..... 123/373, 372, 367, 365, 123/198 DB

[56] References Cited

U.S. PATENT DOCUMENTS

| | | | |
|---|---|---|---|
| 2,290,797 | 7/1942 | Benjamin | 123/373 |
| 2,865,347 | 12/1958 | Rossa | 123/373 |
| 3,659,570 | 5/1972 | Yoshino | 123/373 |
| 3,795,232 | 3/1974 | Snook | 123/198 DB |
| 3,923,025 | 12/1975 | Isobe et al. | 123/373 |
| 4,148,289 | 4/1979 | Hewitt | 123/198 DB |
| 4,148,290 | 4/1979 | Knorreck | 123/373 |

*Primary Examiner*—Ira S. Lazarus
*Assistant Examiner*—Magdalen Moy
*Attorney, Agent, or Firm*—Edwin E. Greigg

[57] ABSTRACT

A centrifugal rpm governor, intended in particular for Diesel vehicle engines, is proposed, by means of which the supply quantity adjustment member of the injection pump is held in the stop position after the engine has been turned off, in order to prevent unauthorized and unintended starting of the engine. The governor is provided with a shut-off lever held in its operational position by a tension spring and by which lever the supply quantity adjustment member of the injection pump is displaceable into its stop position. The tension spring is embodied as a holding spring and so disposed that the shut-off lever both in its operation position and its shut-off position is drawn into the pertinent terminal position and held there. To this end, the force of the holding spring is greater than the force of a deviation spring attached to the control linkage.

3 Claims, 2 Drawing Figures

CENTRIFUGAL RPM GOVERNOR FOR FUEL-INJECTED INTERNAL COMBUSTION ENGINES

BACKGROUND OF THE INVENTION

The invention relates to a centrifugal rpm governor for fuel-injected internal combustion engines as described herein and finally claimed. In known rpm governors provided with a separate shut-off lever, this shut-off lever acts directly or indirectly upon the control rod and thus functions as the supply quantity adjustment member, of the fuel injection pump. The control rod is displaced by mechanical means in the stop direction, and the engine is brought to a stop. After the engine has been shut off, the shut-off lever is guided by a spring back into its operational position, in which the control rod of the fuel injection pump can move freely.

Now, when a vehicle equipped with a Diesel engine and the described governor is parked on an uphill slope or at a location with a steep drop, if there is a defect in or reduction of the braking force of the hand brake or if there is an unauthorized release of the brake and at the same time the gear is not set at idling, the Diesel engine can turn over by itself because of the rolling vehicle, and the vehicle can drive off without an operator. There is thus the necessity of providing a safety apparatus which prevents self-starting or unauthorized starting when the engine is turned off.

OBJECTS AND SUMMARY OF THE INVENTION

Because of the centrifugal rpm governor in accordance with the invention, unintended or unauthorized starting of the engine is impossible. As a result of the tension spring serving as a holding spring, the shut-off lever remains in its shut-off position which holds the supply quantity adjustment member in the stop position even when the operating lever, for example, of the governor is pressed into the full-load position, because then the deviation spring, which is less stiff than the holding spring, acts as a drag member and is stretched or compressed depending on the structure of the drag member. A further advantage resides in the particular embodiment of the governor, which is extremely simple to manufacture and consequently is inexpensive.

In a centrifugal rpm governor having a shut-off lever which is pivotable about a shut-off shaft, a simple arrangement which requires no additional structural parts and therefore saves space.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
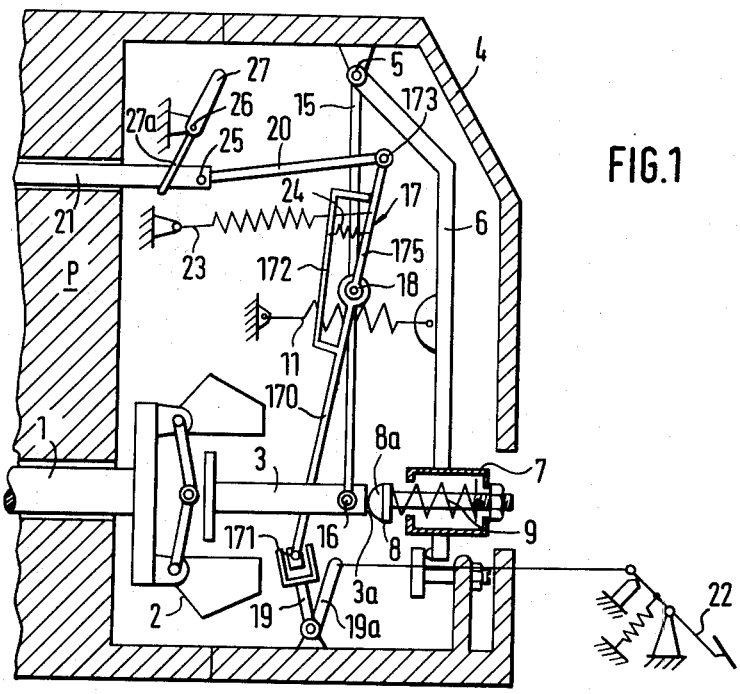
FIG. 1 is a simplified cross-sectional view of one practical exemplary embodiment of the rpm governor in accordance with the invention.

Turning now to the drawing, as FIG. 1 shows, flyweights 2 are articulatedly secured on a camshaft 1 of a fuel injection pump P (indicated only in part). In a known manner, these flyweights 2 act upon one end of a governor sleeve 3 which serves as the control member, and their rpm-dependent pivoting motion is translated into a longitudinal motion on the part of the governor sleeve 3. The upper end of a tension lever 6 is rotatably supported on a bearing pin 5 that is secured in the governor housing 4. A compression bolt 8 is displaceably disposed in a spring capsule 7 that is secured to the lower end of the tensioning lever 6. The end **8*a* of the compression bolt 8 which is oriented toward the flyweights 2 contacts one end face 3*a* of the governor sleeve 3. The compression bolt 8, which is displaceable within the spring capsule 7, is held in the position shown by an idling spring 9, which is supported at one end on the head 8*a* of the compression bolt 8 and on the other end in the base of the spring capsule 7. A final rpm control spring 11 which is arranged to control the highest rpm to be governed is disposed between the tensioning lever 6 and a fastening means that is secured to the housing 4. The initial stressing of this spring 11 acts via the tensioning lever 6 upon the governor sleeve 3**.

When the engine is running, the flyweights 2 press with a displacement force corresponding to the engine rpm against the governor sleeve 3 and displace it, depending on the rpm at that moment, against the force of the idling spring 9 during idling control or against the force of the final rpm control spring 11 when the set maximum rpm is exceeded.

Pivotably supported on the bearing pin 5 is also the upper end of a guidance lever 15, whose lower end is connected in an articulated manner with the governor sleeve 3 by means of a pin 16. Further pivotably supported by means of a pin 18 secured substantially medially of this guidance lever 15, is a two-part intermediate lever 17, which may also be called a swing lever and which comprises two partial levers 170 and 175 pivotable about the pin 18. An adjustment lever 19 engages an articulation point 171 attached to the lower end of the first partial lever 170 and holds this partial lever 170, during idling operation of the engine, in the illustrated position. The outermost end 173 of the second partial lever 175 is connected via a link 20 with the control rod 21, which serves as the supply quantity adjustment member of the injection pump P. A portion **19*a* of the adjustment lever 19 located outside the governor housing 4 (see also FIG. 2) is actuated in a known manner by a gas pedal 22 and pivoted in order to vary the supply quantity which it is intended to set. The articulation point 171 is thereby displaced by the intermediate lever 17, with the intermediate lever 17 being pivoted about the instantaneous pivot point 18, and the control rod 21 thereby accordingly adjusted. A starting spring 23 that is secured on the governor housing 4 further engages the second partial lever 175**.

Upon a variation in rpm and the positional displacement thus resulting in the governor sleeve 3, the guidance lever 15 is pivoted about the bearing pin 5 and the intermediate lever 17 is thereby pivoted by means of the pin 18 about the articulation point 171, which now acts as the instantaneous pivot point, and the control rod 21 is accordingly displaced in its position. If the control rod 21, in the illustrated position shown in FIG. 1, is displaced toward the right, then the fuel injection quantity is reduced; if it is displaced toward the left instead, then the fuel injection quantity is increased. An inward portion **27*a* of a shut-off lever 27 pivotable about a shut-off shaft 26 is located opposite a transverse pin 25 which connects the link 20 with the control rod 21**.

Figure 2:
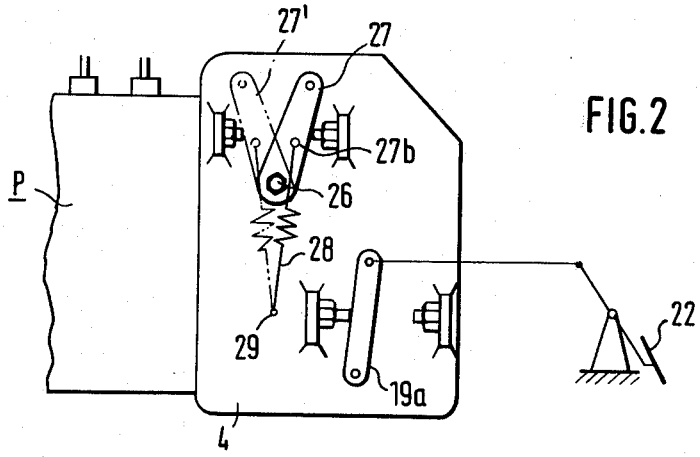
FIG. 2 is an external horizontal plane view of the rpm governor on a reduced scale.

As may be seen from FIG. 2, one end of the holding spring 28 is secured to a suspension point **27*b* on the outer portion of the shut-off lever 27 while the other end of this holding spring 28 is fastened in an appropriate manner to member 29 on the governor housing 4. The fastening point or member 29, viewed in the pivoting plane of the shut-off lever 27, is attached on the governor housing 4 on the side of the shut-off shaft 26 opposite to the shut-off lever 27 and spaced apart from this shut-off shaft 26. The position of the fastening point 29 shown in FIG. 2 is set in such a manner that, as is indicated by solid lines, when the shut-off lever 27 is in the operational position it is held in this position by the pull of the holding spring 28; however, as indicated by dot-dash lines in FIG. 2, when the shut-off lever is in its shut-off position, the holding spring 28 also holds the shut-off lever in position, in this case that position marked as 27'. The tensioning force of the holding spring 28, which is embodied as a tension spring, in the two end positions of the shut-off lever 27 indicated at 27 and 27', is always greater than the force exerted by a deviation spring 24 (see FIG. 1) upon the two partial levers 170 and 175. The deviation spring 24 draws the second partial lever 175, in the initial position as shown, against a lever portion 172 firmly attached to the first partial lever 170, and the entire arrangement therby acts as a drag member, which in a known manner can also be replaced by a resilient element inserted in place of the link 20. This drag member has the function of preventing overstressing of the control linkage, and its initial stressing is set to be weaker than the holding force of the holding spring 28, so that when the shut-off lever is in the shut-off position marked 27', and upon actuation of the gas pedal 22 and the corresponding pivoting on the part of the intermediate lever 17, the control rod 21 cannot move, because the weaker deviation spring 24 yields and only the first partial lever 170 rotates, while the second partial lever 175 and thus the control rod 21 as well are held firmly in the stop position by the inner shut-off lever 27*a***.

The deviation spring 24 also functions when the engine is running, in the following manner: When the engine is running, the shut-off lever 27 is in the position shown in FIG. 1—that is, the position indicated in FIG. 2 by solid lines. The inner portion **27*a* does not come into contact with the pin 25 on the control rod 21. When the shut-off lever 27, in order to turn off the engine, is pivoted counterclockwise and brought into its second position, indicated by dot-dash lines and marked 27' in FIG. 2, then the inner portion 27*a* of the shut-off lever 27 is caused to press against the transverse pin 25 and thus displaces the control rod 21 into its stop position, in which no further supply quantity is delivered by the fuel injection pump P and the engine comes to a stop. Without varying the position of the other portions of the control linkage which are positionally set by the adjustment lever 19 and controlled by the governor sleeve 3, the second partial lever 175 is thereby pivoted by the link 20 about the pin 18 against the force of the deviation spring 24. The second partial lever 175 thereby moves away from the lever portion 172 of the first partial lever 170. Thus, as a result of the deviation spring 24, which is weaker than the holding spring 28**, such small forces are brought to bear against the control linkage that there is no danger whatever of overstressing.

By means of the structure described above and the initial stressing of the holding spring 28, and through the arrangement of the deviation spring 24, it is assured for all desired and undesired operational eventualities that when the shut-off lever 27 is pivoted into its shut-off position 27', the control rod 21 of the fuel injection pump P is always held in the stop position. Thus, the desired safety function of the holding spring 28 is achieved in a simple fashion, and the auto-igniting Diesel engine cannot turn over by itself even in the event of unauthorized pushing, unintended rolling, and released brakes.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. A centrifugal rpm governor for fuel-injected Diesel engines, comprising a control member displaceable in position by the force of flyweights, a control linkage arranged to transmit a signal indicative of the change in position of said control member onto a supply quantity adjustment member, a shut-off lever associated with said supply quantity adjustment member arranged to be moved into an operational position by a tension spring to turn off said engine, a deviation spring means arranged to prevent overstressing of said control linkage upon actuation of said shut-off lever, and said deviation spring means including a holding spring and a deviation spring, said holding spring being disposed on said shut-off lever so that said shut-off lever is held by said holding spring, both in said operational position and a shut-off position and that the force with which said shut-off lever is held in its shut-off position is greater than the force of said deviation spring.

2. A centrifugal rpm governor in accordance with claim 1, wherein said shut-off lever has a swingable free portion and an attached portion, said attached portion being pivotable about a shaft means and said holding spring is arranged to snap said shut-off lever into an operational position from the shut-off position and vice versa.

3. A centrifugal rpm governor in accordance with claim 1, wherein said shut-off lever is pivotable about a shut-off shaft, one end of the holding spring is suspended from a suspension point on the shut-off lever and the other end is suspended from a fastening point which is located in the pivoting plane of the shut-off lever and is attached to the governor housing on the side of the shut-off shaft opposite the shut-off lever.

* * * * *